US008240651B2

(12) United States Patent
Mitani

(10) Patent No.: US 8,240,651 B2
(45) Date of Patent: Aug. 14, 2012

(54) POST-PROCESSING DEVICE

(75) Inventor: Koichi Mitani, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 12/963,656

(22) Filed: Dec. 9, 2010

(65) Prior Publication Data

US 2011/0148023 A1 Jun. 23, 2011

(30) Foreign Application Priority Data

Dec. 18, 2009 (JP) ..... 2009-287533

(51) Int. Cl.
*B65H 37/06* (2006.01)

(52) U.S. Cl. ..... 270/37; 270/45; 493/444; 493/445

(58) Field of Classification Search ..... 270/37, 270/45; 493/444, 445
See application file for complete search history.

(56) References Cited

U.S. PATENT DOCUMENTS

| | | | | |
|---|---|---|---|---|
| 2,777,689 | A * | 1/1957 | Martin | 493/23 |
| 2,804,298 | A * | 8/1957 | Buss | 493/8 |
| 4,569,672 | A * | 2/1986 | Marion et al. | 493/359 |
| 7,077,393 | B2 * | 7/2006 | Ishida | 270/37 |
| 7,077,798 | B2 * | 7/2006 | Kawatsu et al. | 493/421 |
| 7,111,837 | B2 * | 9/2006 | Itou et al. | 270/45 |
| 7,326,166 | B2 * | 2/2008 | Sytema | 493/421 |
| 7,597,311 | B2 * | 10/2009 | Kawata et al. | 270/37 |
| 7,866,644 | B2 | 1/2011 | Oshiro et al. | |

FOREIGN PATENT DOCUMENTS

| | | |
|---|---|---|
| JP | H5-229516 | 9/1993 |
| JP | 2003-335455 A | 11/2003 |
| JP | 2006-264869 | 10/2006 |
| JP | 2007-153616 | 6/2007 |
| JP | 2009-001417 | 1/2009 |

OTHER PUBLICATIONS

Notification of Reason for Refusal issued Nov. 22, 2011 in corresponding Japanese Patent Application No. 2009-287533, and the English translation thereof.

English translation of Notification of Reasons for Refusal issued in Japanese Patent Application No. 2009-287533, mailed Feb. 21, 2012, and English translation thereof.

* cited by examiner

*Primary Examiner* — Patrick Mackey

(74) *Attorney, Agent, or Firm* — Buchanan Ingersoll & Rooney PC

(57) ABSTRACT

A post-processing device includes a pair of rollers, each arranged such that an axis direction thereof is perpendicular to a transport direction of recording sheets, that forms a fold in the axis direction at a predetermined portion of both surfaces of each recording sheet, a first plate-like member, arranged opposite the pair of rollers, that moves between a feeding position allowing the predetermined portion of each recording sheet to be pinched with a nip portion of the pair of rollers and a standby position being distant from the nip portion, a transport processing unit that causes the recording sheets to be sequentially transported such that the predetermined portion of each recording sheet intervenes between the first plate-like member and the pair of rollers and to be folded by the pair of rollers, and a post-processing unit bundles the recording sheets on each of which the fold has been formed.

8 Claims, 17 Drawing Sheets

POST-PROCESSING DEVICE

CROSS-REFERENCE TO RELATED APPLICATIONS

This application is based on application No. 2009-287533 filed in Japan, the contents of which are hereby incorporated by reference.

BACKGROUND OF THE INVENTION (1) Field of the Invention

The present invention relates to a post-processing device for performing folding processing on recording sheets on which image have been formed and which have been outputted from an image forming device, and particularly to a technique for preventing a recording sheet from swelling at a portion in the vicinity of a fold formed by the folding processing.

(2) Related Art

In recent years, a post-processing device that is capable of making a booklet by performing folding processing or saddle stitching binding on sheets on which images have been formed by an image forming device using a photo copying technique has been available.

According to such a post-processing device, folding processing is performed by pinch of a set of sheets at a portion to be folded with a folding roller pair. In such a case, a set of sheets may be swollen in the vicinity of a portion having been folded by the folding roller pair.

Such sets of sheets having gone through the folding processing are sequentially outputted to an output tray and stacked on the output tray with the folded portion coming first. As a result, a forward portion that is around the folded portion of each set of sheets stacked on the output tray (downstream in the outputting direction of the set of sheets) is raised relative to a backward portion of the set of sheets (upstream in the outputting direction of the set of sheets). Thus, the stacked sets of sheets are out of alignment, and the alignment in the stacking direction of the sets of sheets is likely to be out of order.

As a technique for reducing a swelling amount in the vicinity of the folded portion in the folding processing, Patent Literature 1 (Japanese Patent Application Publication No. 2003-335455) discloses a technique for making a mountain-shaped crease, and a valley-shaped crease (hereinafter, referred to as "crease on both sides") on a set of sheets at a portion to be folded by the folding processing before execution of the folding processing.

More specifically, two pairs of a protruding roller having a ring-shaped protrusion in the outer circumference thereof and a recessed roller having a groove, which corresponds to the ring-shaped protrusion of the protruding roller, in the outer circumference thereof are disposed with the protruding roller and the recessed roller alternating each other in a sheet transport direction. When a set of sheets passes between the protruding roller and the recessed roller with being pinched therebetween, the both sides of each sheet are creased at a portion to be folded by the folding processing.

With this technique, the folding processing is performed after the both sides of each sheet are creased at the portion to be folded, so that the set of sheets can be properly folded by the folding processing. This can reduce the swelling amount in the vicinity of the folded portion formed in the folding processing.

According to a device of Patent Literature 1, two roller pairs are required in order to make a crease. This unfortunately increases the size of the device structure, thereby deteriorating the space efficiency.

Furthermore, according to the above prior art, a crease in the transport direction of the sheet is made on the sheet. Accordingly, in order to make a fold on the sheet along the crease by the folding processing, it is necessary to switch the transport direction to a direction perpendicular to a direction of the crease. This requires an extra space for a mechanism for switching the transport direction.

Furthermore, in a case where each sheet of a set of sheets is thick, merely making a crease on the sheet does not sufficiently prevent swelling of the set of sheets in the vicinity of the portion folded by the folding processing.

SUMMARY OF THE INVENTION

It is an object of the present invention to provide a post-processing device that is capable of preventing a set of sheets from swelling in the vicinity of the portion folded by the folding processing without upsizing the structure of the device.

To achieve the above object, the post-processing device pertaining to the present invention includes a pair of rollers, each arranged such that an axis direction thereof is perpendicular to a transport direction for transporting recording sheets outputted from an image forming device, that forms a fold in the axis direction at a predetermined portion of both surfaces of each recording sheet by pinching the predetermined portion with a nip portion defined between the pair of rollers, a first plate-like member, extending in the axis direction and arranged opposite the pair of rollers, that moves between a feeding position and a standby position, the feeding position being at a position in a vicinity of the nip portion and allowing the predetermined portion of each recording sheet to be pinched with the nip portion, the standby position being distant from the feeding position in a direction away from the nip portion, a transport processing unit that causes the recording sheets to be sequentially transported such that the predetermined portion of each recording sheet intervenes between the first plate-like member and the pair of rollers, moves the first plate-like member from the standby position to the feeding position so as to press one surface of the recording sheet, bend the recording sheet at the predetermined portion and feed the predetermined portion to the nip portion, and drives the pair of rollers so as to form the fold at the predetermined portion, and a post-processing unit that bundles the recording sheets on each of which the fold has been formed at the predetermined portion into a set.

The post-processing device further may include a second plate-like member, arranged downstream from the first plate-like member in the transport direction and arranged opposite the first plate-like member via the pair of rollers, that moves between another feeding position and another standby position, the other feeding position being at a position in a vicinity of the nip portion and allowing the predetermined portion of each recording sheet to be pinched with the nip portion, the other standby position being distant from the other feeding position in a direction away from the nip portion. The transport processing unit may further cause the recording sheets on each of which the fold has been foamed to be sequentially transported such that the predetermined portion of each recording sheet intervenes between the second plate-like member and the pair of rollers, move the second plate-like member from the other standby position to the other feeding position so as to press another surface of the recording sheet, bend the recording sheet at the predetermined portion and feed the predetermined portion to the nip portion, and drive the pair of rollers so as to further form a fold at the predetermined portion.

The transport processing unit has an inversion path through which each recording sheet on which the fold has been formed is inverted, and the transport processing unit may further cause the recording sheets on each of which the fold has been formed to sequentially go through the inversion path so as to invert each recording sheet, causes the inverted recording sheet to be transported such that the predetermined portion of the recording sheet intervenes between the first plate-like member and the pair of rollers, move the first plate-like member from the standby position to the feeding position so as to press another surface of the recording sheet, bend the recording sheet at the predetermined portion and feed the predetermined portion to the nip portion, and drive the pair of rollers so as to further form a fold at the predetermined portion.

The transport processing unit may have a sensor that detects an end of the recording sheet within a transport section, the transport section beginning with an opposing position at which the predetermined portion of each recording sheet intervenes between the first plate-like member and the nip portion and ending with another opposing position at which the predetermined portion intervenes between the second plate-like member and the nip portion.

The transport processing unit may control transportation of each recording sheet according to a count number corresponding to a distance for which the recording sheet has been transported after the sensor detects the end of the recording sheet such that the predetermined portion on which the fold has been formed by the first plate-like member and the nip portion reaches the other opposing position.

The post-processing unit may fold the bundled set of recording sheets at the predetermined portion. When a sheet number of the recording sheets or a thickness of each recording sheet is equal to a threshold value or higher, the transport processing unit may cause each recording sheet to be transported such that the predetermined portion of the recording sheet intervenes between the first plate-like member and the pair of rollers, and cause the predetermined portion to be fed to the nip portion by moving the first plate-like member from the standby position to the feeding position, and when the sheet number of the set of recording sheets or a thickness of each recording sheet is lower than the threshold value, the transport processing unit may inhibit the transportation of the recording sheet such that the predetermined portion of the recording sheet fails to reach the opposing position.

BRIEF DESCRIPTION OF THE DRAWINGS

These and other objects, advantages and features of the invention will become apparent from the following description thereof taken in conjunction with the accompanying drawings which illustrate specific embodiments of the invention.

In the drawings.

DESCRIPTION OF PREFERRED EMBODIMENTS

[Embodiment 1]

[1] Structure of Image Forming System

Figure 1:
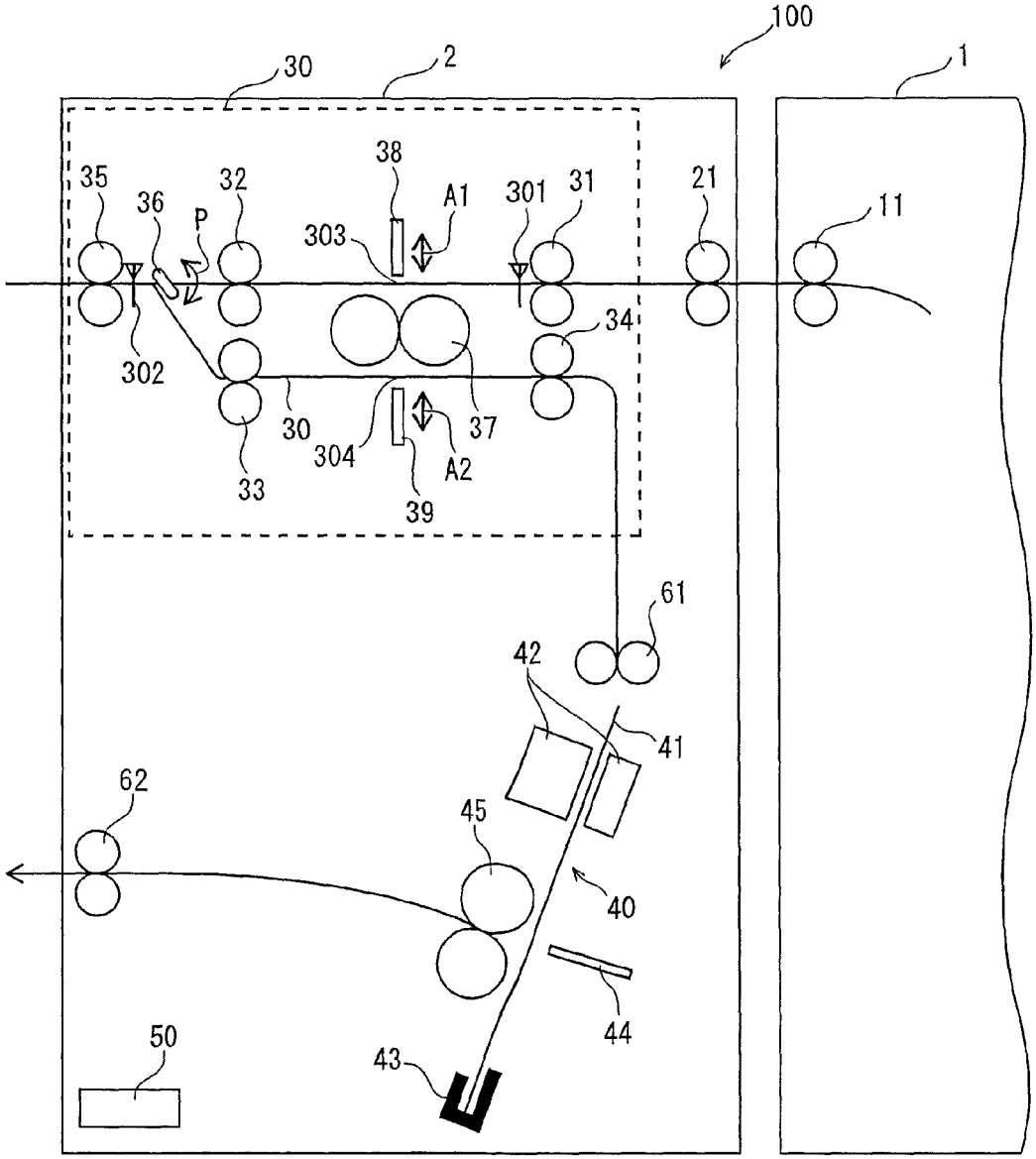
FIG. 1 shows an example of the structure of an image forming system pertaining to an embodiment of the present invention.

FIG. 1 shows an example of the structure of an image forming system 100 pertaining to an embodiment of the present invention. The image forming system 100 is constituted from an image forming device 1 and a post-processing device 2 as shown in FIG. 1.

Figure 2:
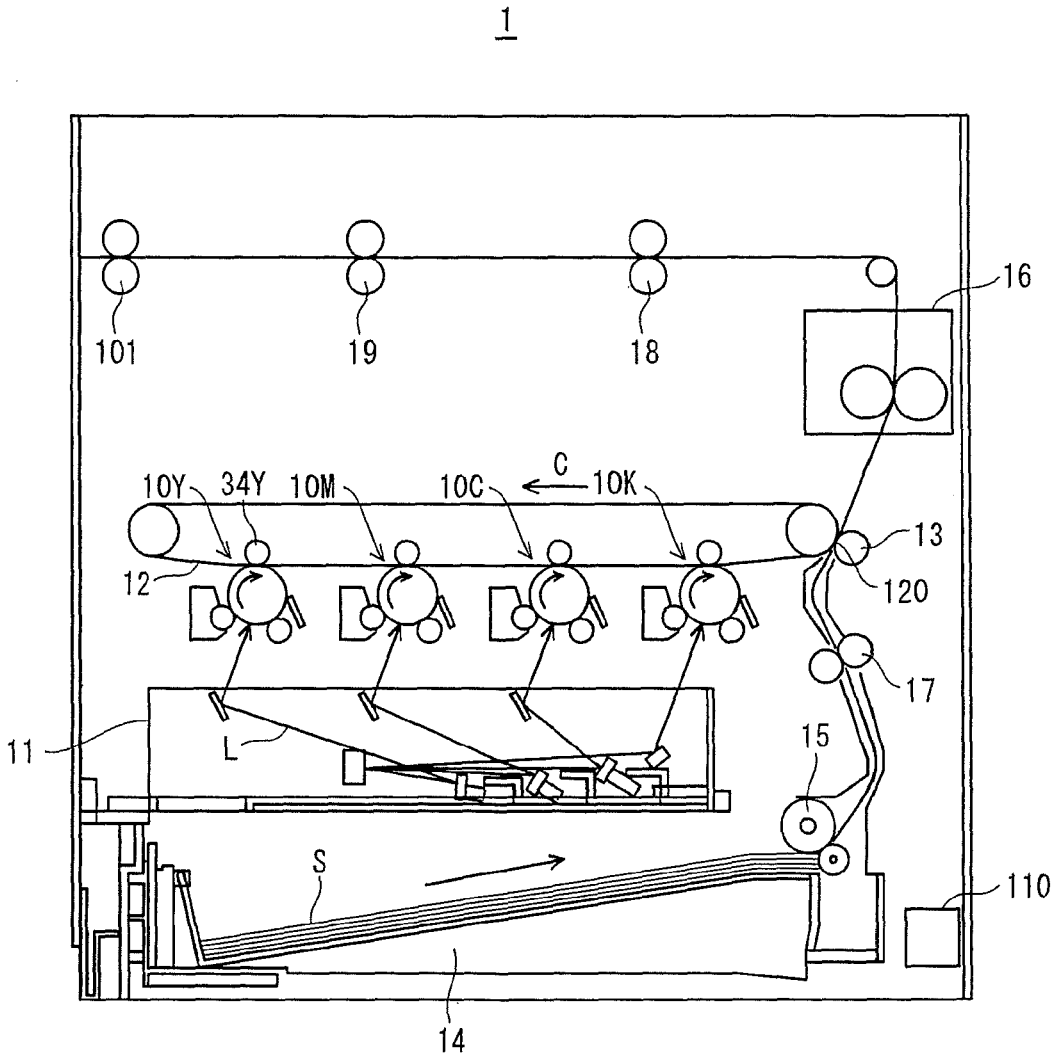
FIG. 2 shows an example of the structure of an image forming device.

FIG. 2 shows an example of the structure of the image forming device 1. The image forming device 1 has image formers 10Y, 10M, 10C and 10K, an exposure part 11, an intermediate transfer belt 12, a secondary transfer roller 13, a feed cassette 14, a pick-up roller 15, a fixer 16, a timing roller pair 17, transport roller pairs 18 and 19, an output roller pair 101 and the control unit 110.

The image formers 10Y-10K each have a photoreceptor drum. The image formers 10Y-10K develop electrostatic latent images formed by scan on each photoreceptor drum by the exposure part 11, thereby forming toner images of colors of yellow (Y), magenta (M), cyan (C), and black (K) colors, respectively. The formed toner images are primarily transferred to the intermediate transfer belt 12.

The feed cassette 14 stores therein sheets represented by the reference sign S. The sheets S are picked up by the pick-up roller 15 one by one and transported. When it is time to transport a sheet to the secondary transfer position 120, the timing roller pair 17 do so.

The secondary transfer roller 13 causes the toner images having been primarily transferred to the intermediate transfer belt 12 to be electrostatically transferred to each sheet S transported to the secondary transfer position 120. The fixer 16 melts the toner images having been secondarily transferred to the sheet S, thereby fixing the toner images to the sheet S by pressure. The sheet S, on which the toner images have been fixed by pressure, is transported to the output roller pair 101 by the transport roller pairs 18 and 19, is outputted outside of the image forming device 1 by the output roller pair 101, and is guided to the post-processing device 2.

As shown in FIG. 1, the post-processing device 2 has a pre-folding processing unit 30, a folding processing unit 40, a control unit 50, an entry roller pair 21, a transport roller pair 61 and an output roller pair 62.

The post-processing device 2 is connected to the image forming device 1 such that it can communicate with the image forming device 1. It is also linked to the image forming device 1 such that the sheets S outputted from the output roller pair 101 of the image forming device 1 can be transported inside the post-processing device 2 by the entry roller pair 21.

The pre-folding processing unit 30 includes transport roller pairs 31-34, an inversion roller pair 35, a path switching unit 36, a pre-folding roller pair 37, a pair of guide plates 38 and 39 opposing each other via the nip portion of the pre-folding roller pair 37, and sheet passage detection sensors 301 and 302. The pre-folding processing unit 30 performs pre-folding on the both surfaces of the sheet S transported from the entry roller pair 21 at a portion to be folded by the folding processing (hereinafter, referred to as "portion to be folded").

The transport roller pair 31 transports the sheet S having been transported from the entry roller pair 21 such that the portion to be folded is transported to an opposing position 303 at which the nip portion of the pre-folding roller pair 37 and the guide plate 38 oppose each other. The guide plate 38 comes in contact with the portion to be folded in the sheet S at the opposing position 303, and moves between the opposing position 303 and the nip portion of the pre-folding roller pair 37, thereby feeding the portion to be folded of the sheet S to the nip portion. The transport roller pair 32 is for transporting the sheet S to the inversion roller pair 35. The transport roller pair 33 transports the sheet S such that the portion to be folded is transported to an opposing position 304 at which the nip portion of the pre-folding roller pair 37 and the guide plate 39 oppose each other. The guide plate 39 comes in contact with the portion to be folded at the opposing position 304, and moves between the opposing position 304 and the nip portion of the pre-folding roller pair 37, thereby feeding the portion to be folded in the sheet S to the nip portion. The transport roller pair 34 is for guiding each sheet S to the transport path that leads to the folding processing unit 40.

The inversion roller pair 35 is for reversing the transport direction of each sheet S. The path switching unit 36 switches the transport direction of the sheet S between a direction toward the inversion roller pair 35 and a direction toward the opposing position 304 by rotating in the directions shown by the arrows represented by the reference sign P in FIG. 1. The rotation of the path switching unit 36 is controlled by the control unit 50 via an unillustrated driving motor. The sheet passage detection sensors 301 and 302 are each a sensor for detecting passage of each sheet S. The sheet passage detection sensors 301 and 302 are each constituted from a reflect-type sensor (photo-reflector), for example, and detects the forward end and the backward end, in the transport direction, of the sheet S according to whether there is reflected light.

Figure 3:
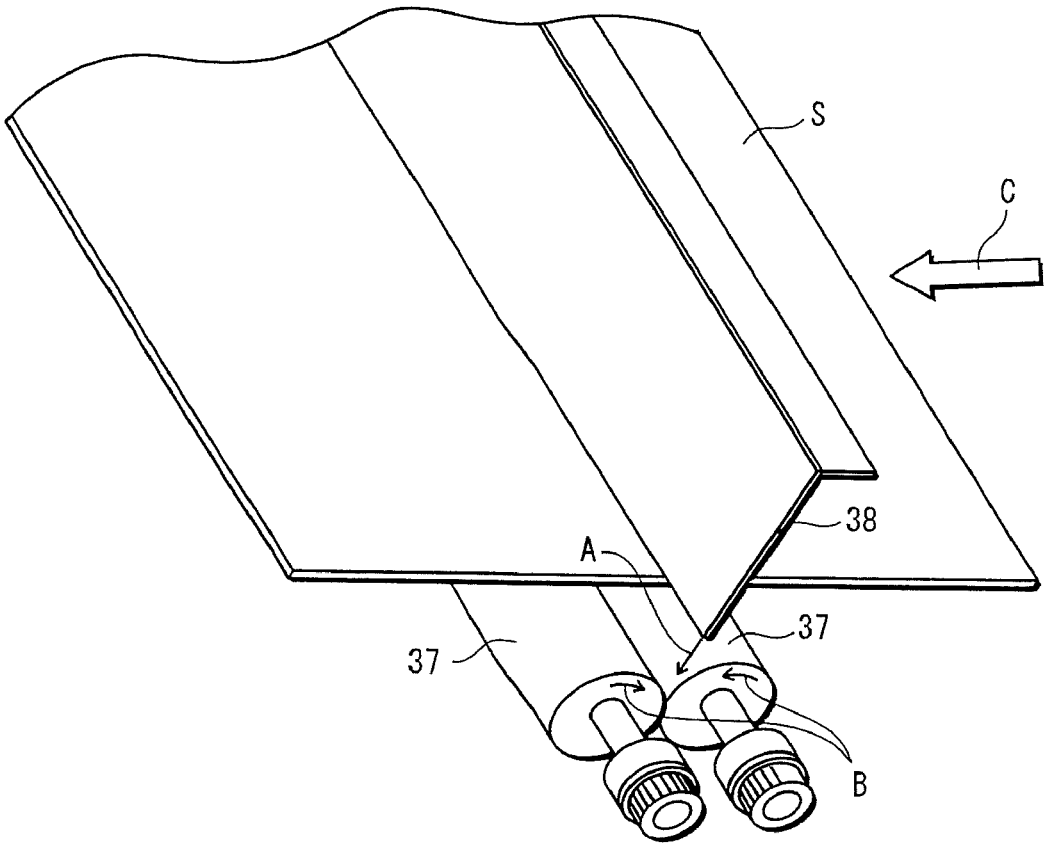
FIG. 3 is a perspective view showing the shape of a guide plate.

FIG. 3 is a perspective view showing the shape of the guide plate 38. As shown in FIG. 3, the guide plate 38 is a thin plate-like member. The guide plate 38 presses, in the arrow direction represented by the reference sign A, each sheet S at the portion to be folded by moving the guide plate using a crank mechanism for moving the guide plate, thereby bending the sheet at the portion, and guides the portion to the entry of the nip portion of the pre-folding roller pair 37. In FIG. 3, the arrow represented by the reference sign B indicates a rotation direction of the pre-folding roller pair 37, and the arrow represented by the reference sign C indicates the transport direction of the sheet S.

Figure 4:
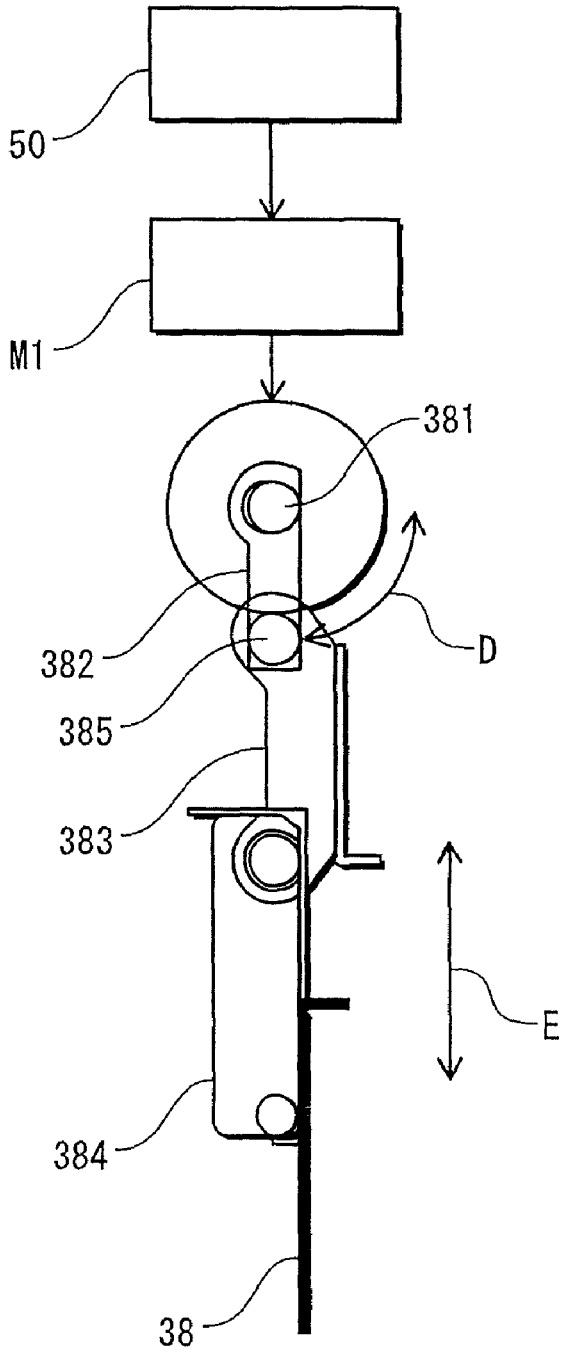
FIG. 4 shows the moving mechanism for moving the guide plate.

FIG. 4 shows a moving mechanism for moving the guide plate 38. The moving mechanism of the guide plate 38 is constituted from a driving motor M1, a rotation shaft 381, an arm plate 382, a link plate 383, and a supporting member 384. The driving motor M1 rotates the rotation shaft 381 via a gear train, thereby swinging the arm plate 382 whose one end is fixed to the rotation shaft (moving it repeatedly back and forth in a range indicated by the double-headed arrow expressed by the reference sign D). The driving of the driving motor M1 is controlled by the control unit 50.

One end of the arm plate 382 is linked to one end of the link plate 383 via a shaft 385, and another end of the link plate 383 is connected to one end of the supporting member 384. The supporting member 384 is configured to be movable in a straight line in the directions shown by the double-headed arrow represented by the reference sign E by an unillustrated guiding member, and the guide plate 38 is fixed to the end of the supporting member 384.

The driving of the driving motor M1 causes the aim plate 382 to swing. The swing of the arm plate 382 causes the supporting member 384 to move in a straight line via the link plate 383, thereby moving the guide plate 38 fixed to the supporting member 384 at the end thereof. As with the guide plate 38, the guide plate 39 is also a thin plate-like member and moves by the similar moving mechanism of the guide plate 38, thereby pressing to bend the sheet S at the portion to be folded and guiding the portion to the entry of the nip portion of the pre-folding roller pair 37. The double-headed arrows represented by the reference signs A1 and A2 in FIG. 1 respectively indicate the directions in which the guide plates 38 and 39 move. Note that a driving motor pertaining to the moving mechanism of the guide plate 39 is referred to as a driving motor M2.

The moving mechanism of the guide plate is not limited to the above-mentioned crank mechanism, and the cam mechanism is also applicable. For example, Patent Literature (Japanese Patent Application Publication No. 2009-1417) discloses "transporting means 110" (see paragraph 0038 of the Description and FIG. 4) as the moving mechanism of the guide plate using the cam mechanism.

The pre-folding roller pair 37 is for pre-folding at the portion to be folded of the sheet S having been guided to the entry of the nip portion by the guide plate 38 or 39. More specifically, the pre-folding roller pair 37 makes a preliminary fold in the portion to be folded by rotating in the pinching direction so as to guide the portion having been guided to the entry of the nip portion to a position past the nip portion, and reversing the rotation to return the portion to be folded to the entry of the nip portion. The pre-folding roller pair 37 is driven by an unillustrated driving motor M3, and the driving of the driving motor M3 is controlled by the control unit 50.

The folding processing unit 40 has a stack tray 41, a stapler 42, a stacker 43, a guide plate 44, a folding roller pair 45 and the like. The stack tray 41 is a sheet stacking tray for holding thereon sheets S transported from the transport roller pair 61. The stapler 42 performs saddle stitching binding processing on the sheets S. The stacker 43 is for receiving the sheets S transported to the stack tray 41 and aligns the backward ends, in the transport direction, of the sheets. The guide plate 44 and the folding roller pair 45 are for performing folding processing on a set of a plurality of sheets S received at the stacker 43.

The stacker 43 is driven by an unillustrated driving motor so as to move in the transport direction of the sheet S. The moving position of the stacker 43 is controlled by the control unit 50. With this, a set of sheets S held at the stacker 43 can be moved to a position at which the saddle stitching binding is performed and a position at which folding processing is performed.

As with the guide plates 38 and 39, the guide plate 44 is a thin plate-like member that can be moved by the moving mechanism. The guide plate 44 presses the set of sheets S held in the stacker 43 at the portion to be folded and bends it, thereby guiding the portion of the set of sheets S to the entry of the nip portion of the folding roller pair 45. The folding roller pair 45 rotates in a direction so as to pinch the set of sheets having been guided to the entry of the nip portion at the portion to be folded, and folds the set of sheets S by making the set of sheets S pass through the nip portion. The folded set of sheets S is outputted by the output roller pair 62 to an unillustrated output tray.

[2] Structure of Control Unit 50

Figure 5:
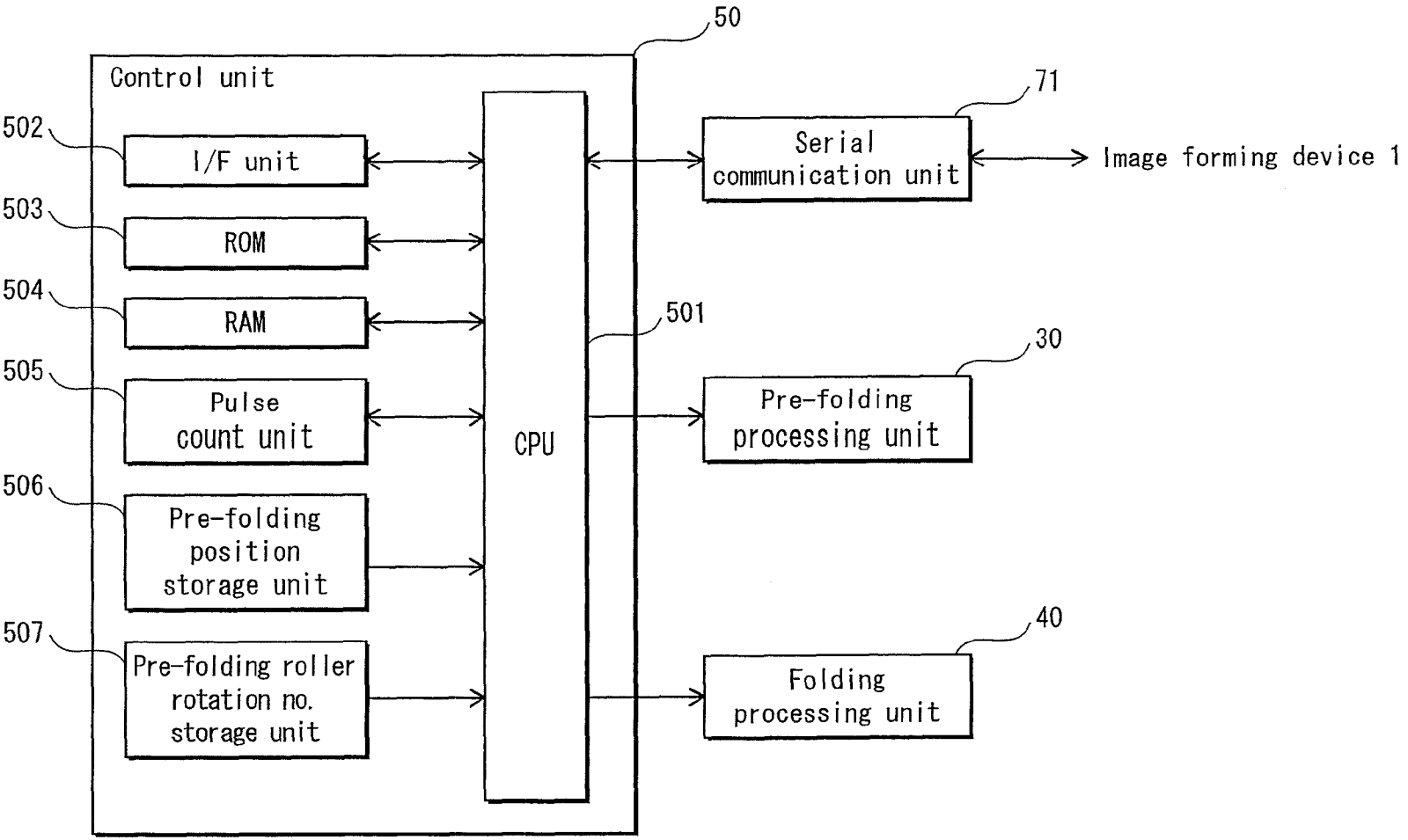
FIG. 5 shows the structure of a control unit of the post-processing device.

FIG. 5 shows the structure of the control unit 50 of the post-processing device 2. As shown in FIG. 5, the control unit 50 includes a CPU (Central Processing Unit) 501, a communication interface (UF) unit 502, a ROM (Read Only Memory) 503, a RAM (Random Access Memory) 504, a pulse count unit 505, a pre-folding position storage unit 506, a pre-folding roller rotation number storage unit 507 and the like.

The I/F unit 502 is an interface for being connected to a LAN such as a LAN card and a LAN board. The ROM 503 stores therein programs and the like for executing folding processing, which will be described later, in addition to programs necessary for controlling a serial communication unit 71, the pre-folding processing unit 30, the folding processing unit 40 and the like. Each program stored in the ROM 502 is read out and executed by the CPU 501.

The RAM 504 is used as a working area of the CPU 501 when a program is executed.

The pulse count unit 505 counts the driving pulse number to be outputted to driving motors that drive the transport roller pair 31 and 33, and the inversion roller pair 35.

The pre-folding position storage unit 506 stores therein a first pre-folding position Count number and a second pre-folding position count number. Here, the "first pre-folding position count number" means a driving pulse number which is counted from detection of the forward end, in the transport direction, of each sheet S by the sheet passage detection sensor 301 to arrival of the portion to be folded of the sheet S at the opposing position 303 using the transport roller pair 31 and which is to be outputted to a driving motor of the transport roller pair 31.

The "second pre-folding position count number" means a driving pulse number which is counted from detection, by the sheet passage detection sensor 302, of the backward end, in the transport direction, of the sheet S whose transport direction has been inverted by the inversion roller pair 35 to arrival of the portion to be folded of the sheet S at the opposing position 304 using the transport roller pair 33, and which is to be outputted to a driving motor of the transport roller pair 33.

The pre-folding roller rotation number storage unit 507 stores therein the count number for pre-folding. Here, the "count number for pre-folding" is a driving pulse number, of the driving motor M3, that corresponds to each of a rotation number of the pre-folding roller pair 37 in the pinching direction for making a pre-fold on the sheet S at the portion to be folded with the use of the pre-folding roller pair 37 and also corresponds to a rotation number of the pre-folding roller pair 37 in the reverse direction.

The control unit 50 performs serial communication with the image forming device 1 via the serial communication unit 71, and receives various instructions with regard to the folding processing inputted via an unillustrated operation panel of the image forming device 1. The various instructions include the number, the type, the size and the like of sheets S that can be folded at one time (e.g., type of thickness of a sheet), for example.

The serial communication unit 71 is a communication means for connecting the post-processing device 2 and the image forming device 1 to allow interactive communication therebetween, and mediates various type of data exchange between the control unit 50 of the post-processing device 2 and the control unit 110 of the image forming device 1.

[3] Pre-Folding Processing

Figure 6:
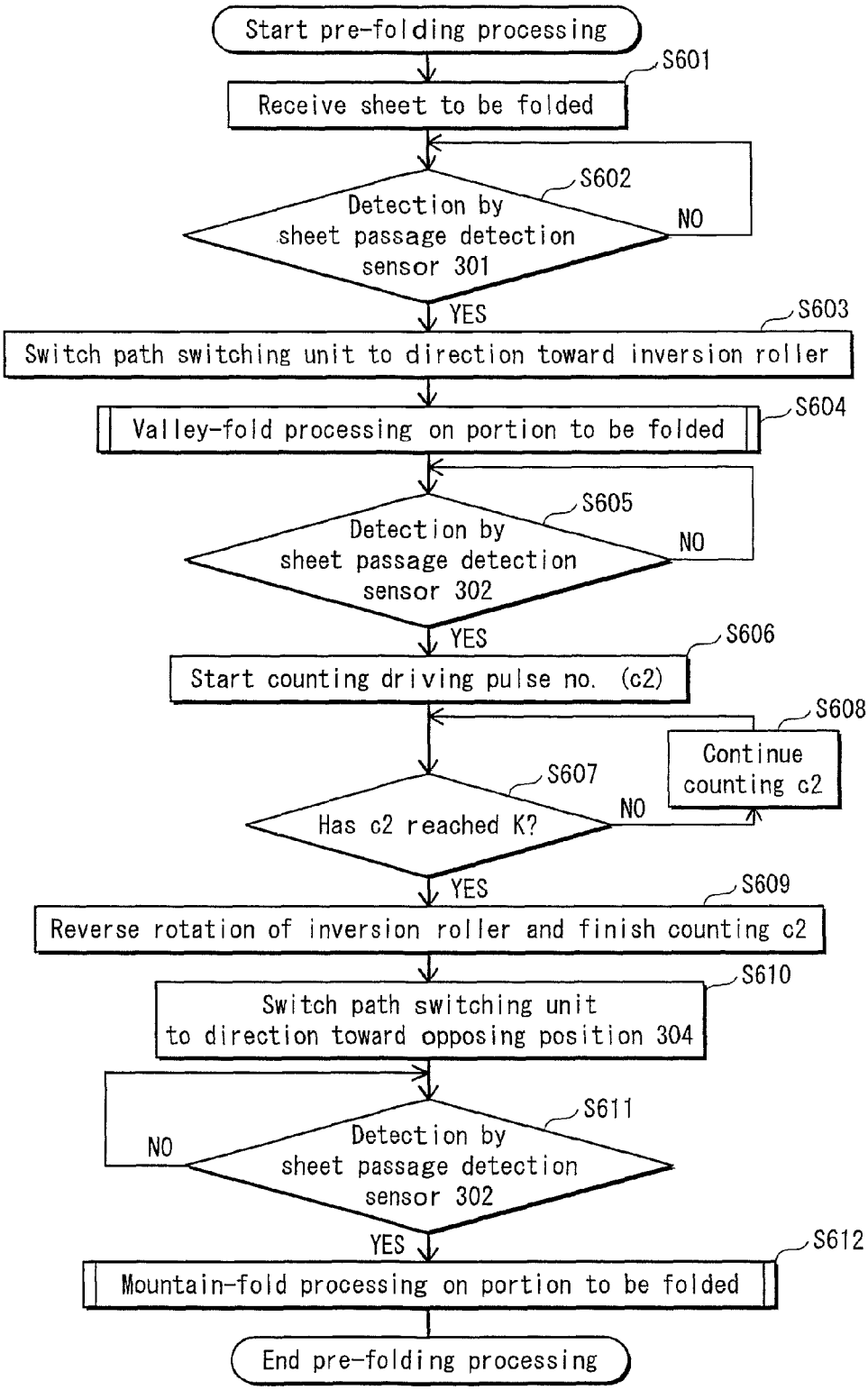
FIG. 6 is a flow chart showing the operation of the pre-folding processing performed by the control unit.

FIG. 6 is a flow chart showing the operation of the pre-folding processing performed by the control unit 50. Upon receiving an instruction to start the folding processing from the image forming device 1 via the serial communication unit 71, the control unit 50 drives the entry roller pair 21 so that the sheet S that has been outputted from the output roller pair 101 of the image forming device 1 and that is to be folded by the folding processing is received (Step S601). The control unit 50 further drives the transport roller pair 31 so as to send the received sheet S to the pre-folding processing unit 30. When the sheet passage detection sensor 301 detects the backward end, in the transport direction, of the sheet S (Step S602: YES), the control unit 50 controls the path switching unit 36 to switch the transport direction to the direction toward the inversion roller pair 35 (Step S603) and valley-fold processing, by which a sheet is folded in a V shape, is performed on the portion to be folded, which will be described later (Step S604).

Completing the valley-fold processing on the portion to be folded, the control unit 50 monitors the sheet passage detection sensor 302. When the forward end, in the transport direction, of the sheet S transported in the direction toward the inversion roller pair 35 is detected (Step S605: YES), the control unit 50 causes the driving motor to drive the inversion roller pair 35, and causes the pulse count unit 505 to start counting the driving pulse number (c2) to be outputted to the driving motor (Step S606).

Till c2 reaches a predetermined driving pulse number (K), the control unit 50 continues to count the driving pulse (Step S607: NO, Step S608). When c2 reaches K (Step S607: YES), the control unit 50 stops the inversion roller pair 35, thereby stopping the pulse count unit 505 from counting c2, and subsequently causes the rotation of the inversion roller pair 35 to reverse (Step S609). Here, K refers to a driving pulse number required for the inversion roller pair 35 to transport the sheet S for a predetermined distance in a range that does not exceed the length of the sheet S in the transport direction.

Subsequently, the control unit 50 causes the path switching unit 36 to switch the transport direction to the direction toward the opposing position 304 (Step S610). The control unit 50 monitors the sheet passage detection sensor 302. When the sheet passage detection sensor 302 detects the backward end, in the transport direction, of the sheet S (Step S611: YES), the control unit 50 performs the mountain-fold processing, by which the sheet is folded in an inverted V shape, on the portion to be folded, which will be described later (Step S612).

Next, a description is given of the valley-fold processing performed by the control unit 50 on the portion to be folded.

Figure 7:
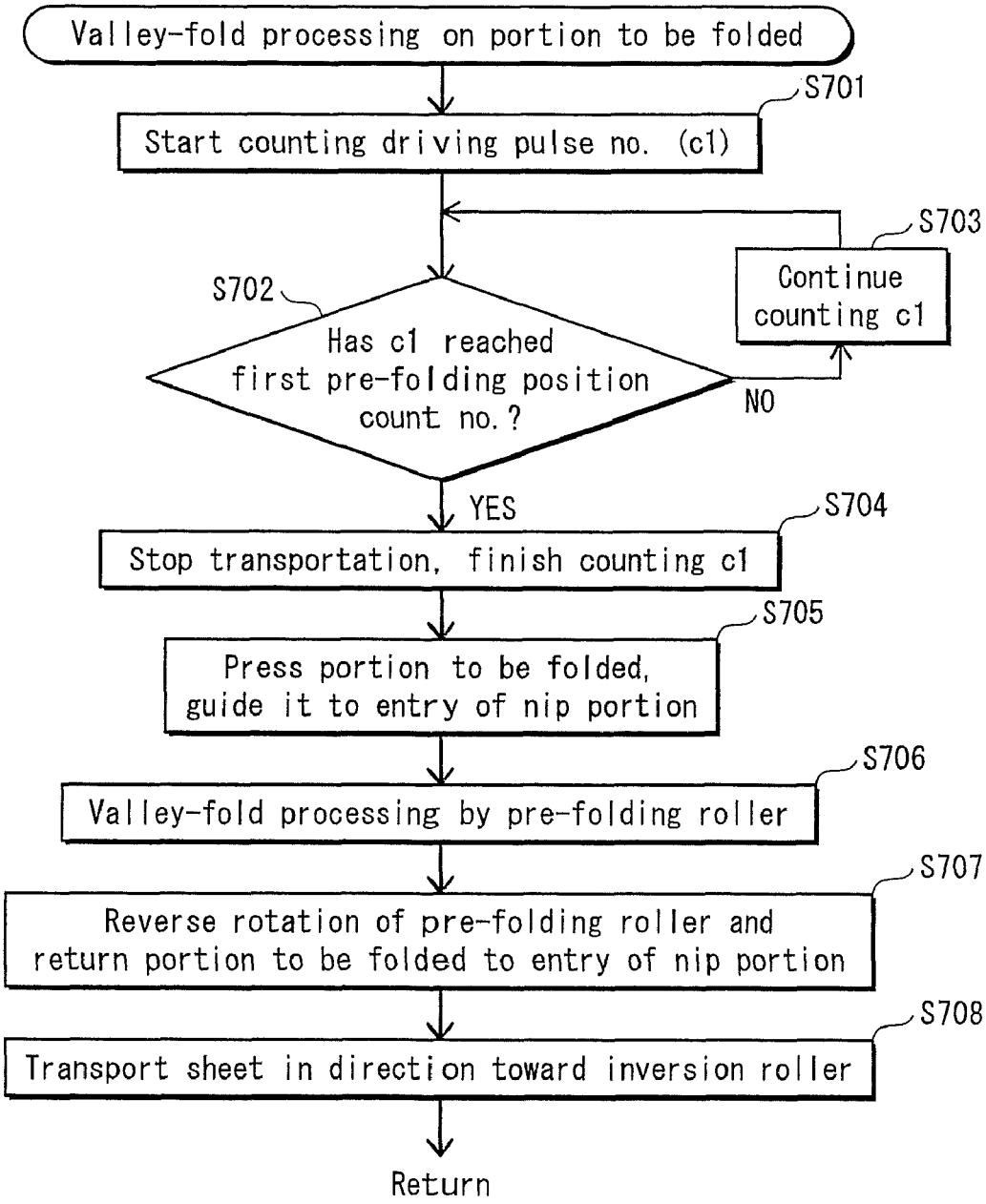
FIG. 7 is a flow chart showing the operation of the valley-fold processing performed by the control unit on a portion to be folded.

FIG. 7 is a flow chart showing the operation of valley-fold processing. The control unit 50 causes the pulse count unit 505 to start counting the driving pulse number (c1) to be outputted to the driving motor of the transport roller pair 31 (Step S701), and continues the counting till c1 reaches the first pre-folding position count number (Step S702: NO, Step S703).

When c1 reaches the first pre-folding position count number (Step S702: YES), on the assumption that the portion to be folded of the sheet S reaches the opposing position 303, the control unit 50 stops the transportation of the sheet S and stops the pulse count unit 505 from counting c1 (Step S704).

Figure 8A:
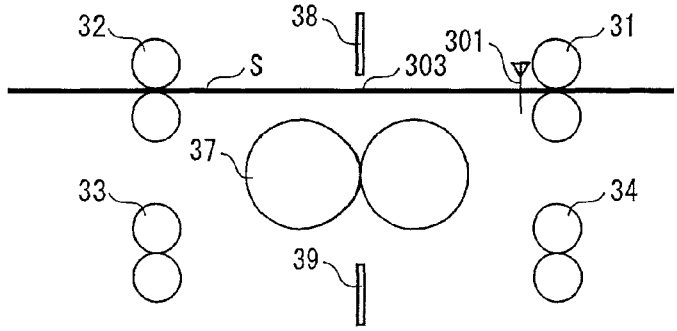
FIGS. 8A-E are each a conceptual diagram showing a state of a sheet S in a step of the valley-fold processing performed by the control unit on the portion to be folded.

FIG. 8A is a conceptual diagram showing a state where the portion to be folded of the sheet S is guided to the opposing position 303. In FIG. 8A, the reference signs 31, 32, 33 and 34 respectively refer to the transport roller pairs 31, 32, 33 and 34. The reference sign 37 refers to the pre-folding roller pair. The reference signs 38 and 39 respectively refer to the guide plates 38 and 39. The reference sign 301 refers to the sheet passage detection sensor 301. The above references are also applicable to FIGS. 8B-8D and FIGS. 10A-E, which will be described later.

Figure 8B:
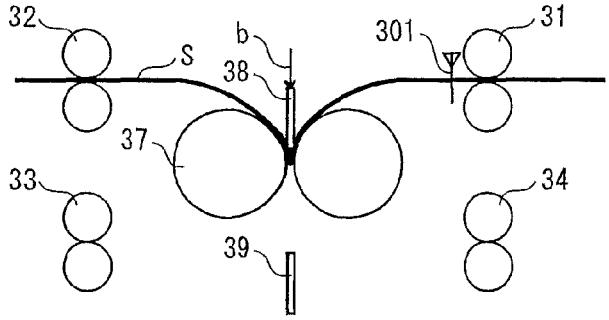

Next, the control unit 50 drives the driving motor M1 so as to move the guide plate 38 in a direction toward the nip portion of the pre-folding roller pair 37, thereby pressing the sheet S at the portion to be folded. Bending the sheet at the portion to be folded by pressing, the guide plate 38 guides the portion to be folded to the entry of the nip portion of the pre-folding roller pair 37 (Step S705). FIG. 8B is a conceptual diagram showing a state where the sheet S is guided to the entry of the nip portion. The arrow represented by the reference sign b in FIG. 8B indicates the moving direction of the guide plate 38.

Figure 8C:
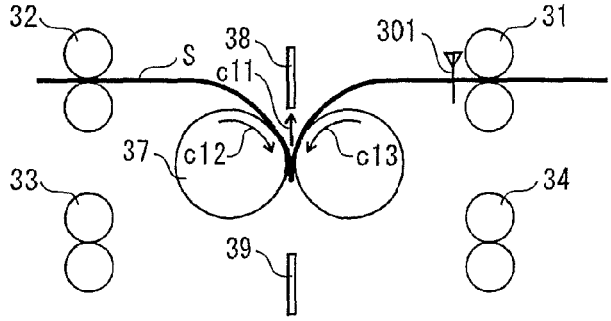

Next, the control unit 50 drives the driving motor M3 so as to rotate the pre-folding roller pair 37, in the direction for pinching the sheet at the portion to be folded, for a rotation number corresponding to the count number for pre-folding, guides the sheet S to allow the portion to be folded to pass through the nip portion, and drives the driving motor M1 so as to move the guide plate 38 in a direction away from the nip portion. Thus, the control unit 50 performs valley-fold processing at the portion to be folded (Step S706). FIG. 8C is a conceptual diagram showing a state where the sheet S has been folded in a V shape (i.e. valley-fold). The arrow represented by the reference sign c11 in FIG. 8C indicates a moving direction of the guide plate 38, and the arrows represented by c12 and c13 each indicate a rotation direction of the pre-folding roller pair 37.

Figure 8D:
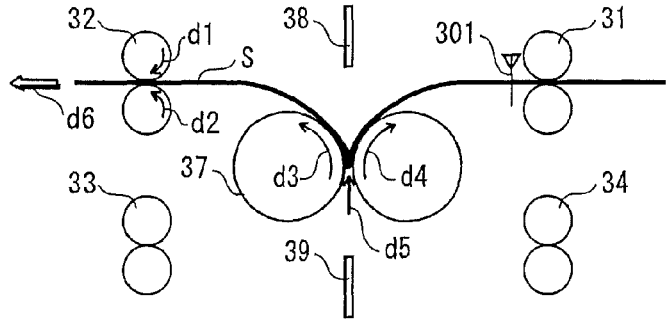
Figure 8E:
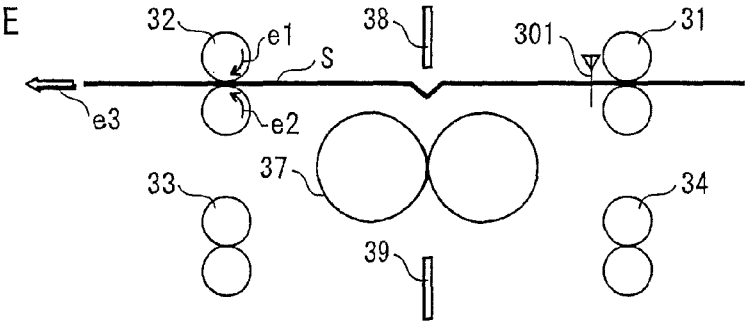

Next, the control unit 50 rotates the pre-folding roller pair 37 in the reverse direction of the pinching direction only for the rotation number corresponding to the count number for pre-folding, and drives the transport roller pair 32 so as to return the portion on which the valley-fold processing has been performed to the entry of the nip portion (Step S707). FIG. 8D shows a state where the portion on which valley-fold processing has been performed is returned to the entry of the nip portion. In FIG. 8D, the arrows represented by the reference signs d1 and d2 each indicate a rotation direction of the transport roller pair 32. The arrows represented by the reference signs d3 and d4 each indicate a rotation direction of the pre-folding roller pair 37. The arrow represented by the reference sign d5 indicates a moving direction of the portion to be folded. The arrow represented by the reference sign d6 indicates a direction in which each sheet S is transported. After that, the control unit 50 causes the sheet S pre-folded in a V shape to be transported in the direction toward the inversion roller pair 35 (Step S708). FIG. 8E shows a state where the sheet S pre-folded in a V shape is being transported. In FIG. 8D, the arrows represented by the reference signs e1 and e2 each indicate a rotation direction of the transport roller pair 32. The arrow represented by the reference signs e3 indicates a direction in which the sheet S is transported.

Figure 9:
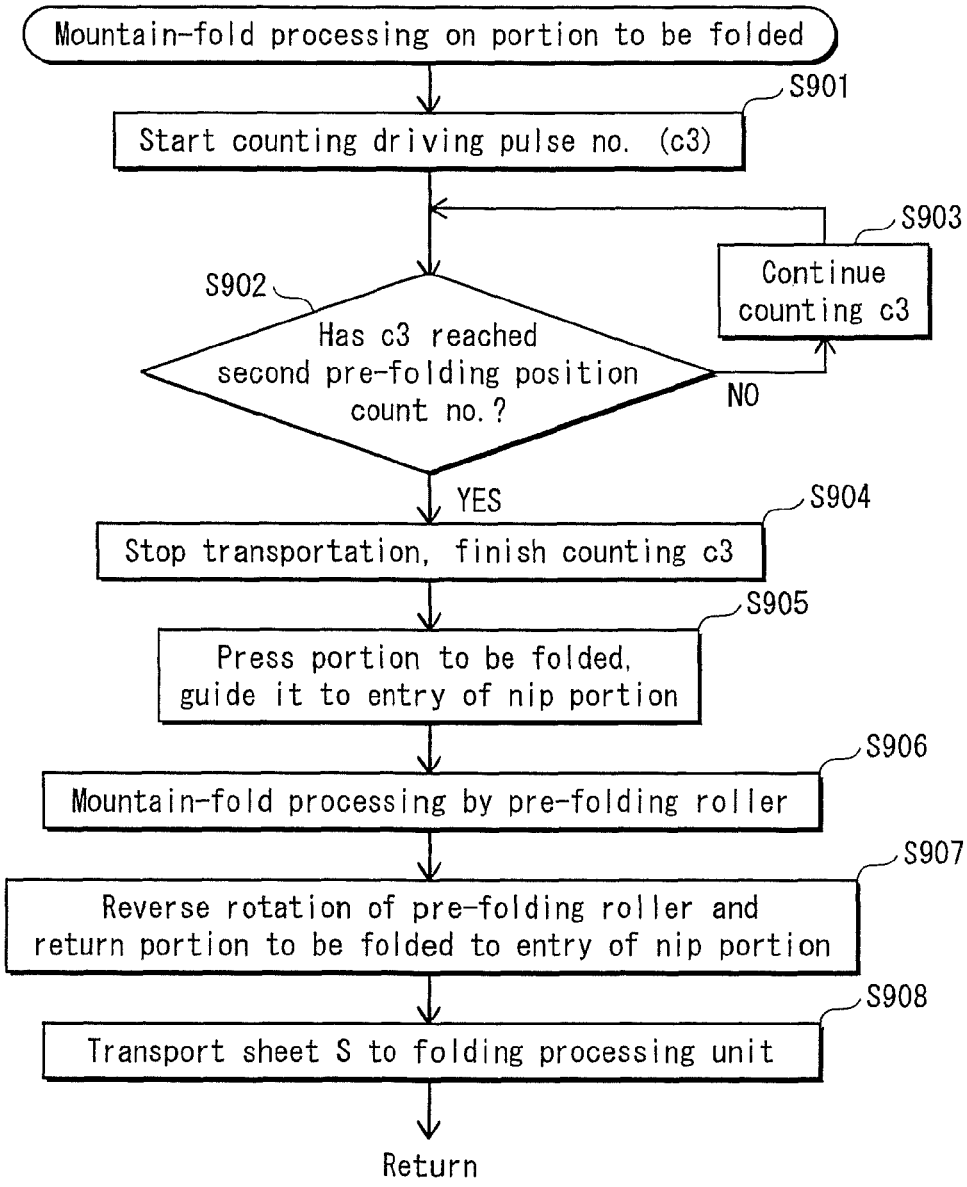
FIG. 9 is a flow chart showing the operation of the mountain-fold processing performed by the control unit on the portion to be folded.

Next, a description is given of the mountain-fold processing performed by the control unit 50 on the portion to be folded. FIG. 9 is a flow chart showing the operation of the mountain-fold processing. Subsequently, the control unit 50 drives the transport roller pair 33. The pulse count unit 505 starts counting the driving pulse number (c3) to be outputted to the driving motor of the transport roller pair 33 (Step S901), and continues counting c3 till c3 reaches the second pre-folding position count number (Step S902: NO, Step S903).

Figure 10A:
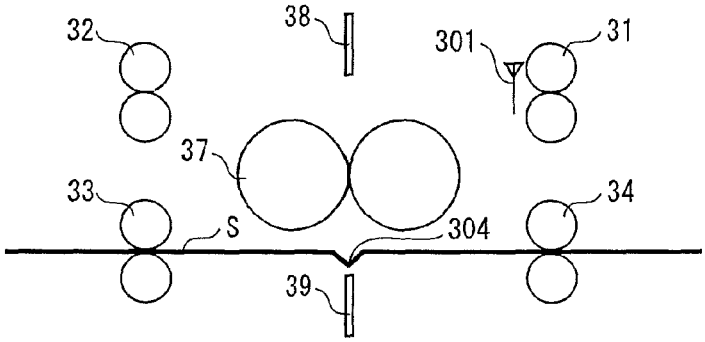
FIGS. 10A-E are each a conceptual diagram showing a state of a sheet S in a step of the mountain-fold processing performed by the control unit on the portion to be folded.

When c3 reaches the second pre-folding position count number (Step S902: YES), on the assumption that the portion to be folded of the sheet S reaches the opposing position 304, the transportation of the sheet S is stopped, and the pulse count unit 505 stops counting c3 (Step S904). FIG. 10A is a conceptual diagram showing a state where the sheet S is guided to the opposing position 304.

Figure 10B:
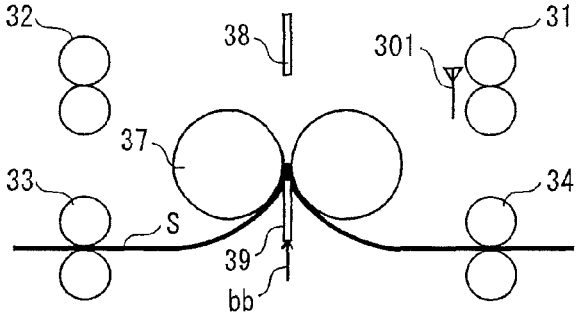

Next, the control unit 50 drives the driving motor M2 so as to move the guide plate 39 in the direction toward the nip portion of the pre-folding roller pair 37, thereby pressing the sheet S at the portion to be folded. The portion to be folded is guided to the entry of the nip portion of the pre-folding roller pair 37 with the sheet S being bent at the portion to be folded (Step S905). FIG. 10B is a conceptual diagram showing a state where the portion to be folded of the sheet S is guided to the entry of the nip portion. The arrow represented by the reference sign bb in FIG. 10B indicates a moving direction of the guide plate 39.

Figure 10C:
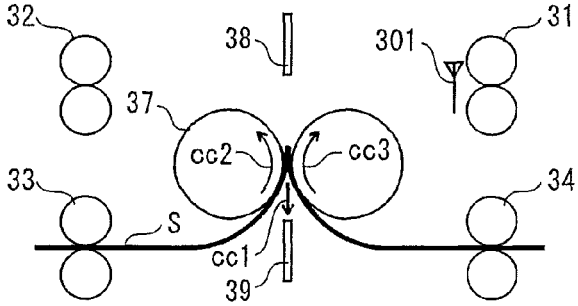

Next, the control unit 50 drives the driving motor M3 so as to rotate the pre-folding roller pair 37, in the direction for pinching the portion to be folded, for a rotation number corresponding to the count number for pre-folding, guides the sheet S to allow the portion to be folded to pass through the nip portion and drives the driving motor M2 so as to move the guide plate 39 in a direction away from the nip portion. Thus, the control unit 50 performs mountain-fold processing on the portion to be folded (Step S906). FIG. 10C is a conceptual diagram showing a state where the sheet S has been pre-folded in an inverted V shape (i.e. mountain-fold). The arrow represented by the reference sign cc1 in FIG. 10C indicates a moving direction of the guide plate 39, and the arrows represented by the reference signs cc2 and cc3 each show a rotation direction of the pre-folding roller pair 37.

Figure 10D:
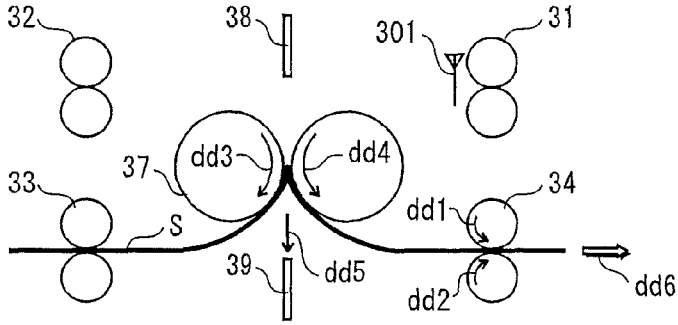
Figure 10E:
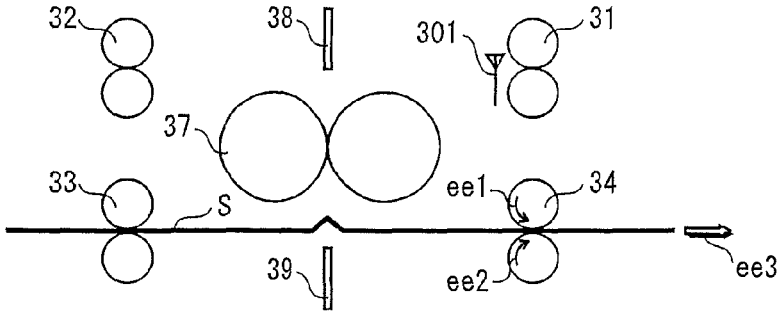

Next, the control unit 50 rotates the pre-folding roller pair 37 in the reverse direction of the pinching direction for a rotation number corresponding to the count number for pre-folding, thereby returning the portion on which mountain-fold processing has been performed to the entry of the nip portion (Step S907). FIG. 10D shows a state where the portion to be folded of the sheet folded in an inverted V shape is returned to the entry of the nip portion. In FIG. 10D, the arrows represented by the reference signs dd1 and dd2 each indicate a rotation direction of the transport roller pair 34. The arrows represented by the reference signs dd3 and dd4 each indicate a rotation direction of the pre-folding roller pair 37. The arrow represented by the reference sign dd6 indicates a direction in which the sheet S is transported. Subsequently, the control unit 50 drives the transport roller pair 34 to transport the sheet S folded in an inverted V shape in the direction toward the folding processing unit 40 (Step S908). FIG. 10E shows a state where the sheet S folded in an inverted V shape is being transported. In FIG. 10E, the arrows represented by the reference signs ee1 and ee2 each indicate a rotation direction of the transport roller pair 34. The arrow represented by the reference sign ee3 indicates a direction in which the sheet S is transported.

[Embodiment 2]

According to Embodiment 1, the guide plates 38 and 39 are provided via the nip portion of the pre-folding roller pair 37 in a direction perpendicular to the sheet transport direction, and form a pre-fold in the portion to be folded on each of the both sides of the sheet S by guiding the portion to each of the both opposing positions 303 and 304 that are opposite each other via the nip portion. Embodiment 2 is different from Embodiment 1 in that only one guide plate is provided at a position opposite the nip portion, and that the both sides of the sheet is pre-folded at the portion to be folded by reversing the sheet.

Figure 11:
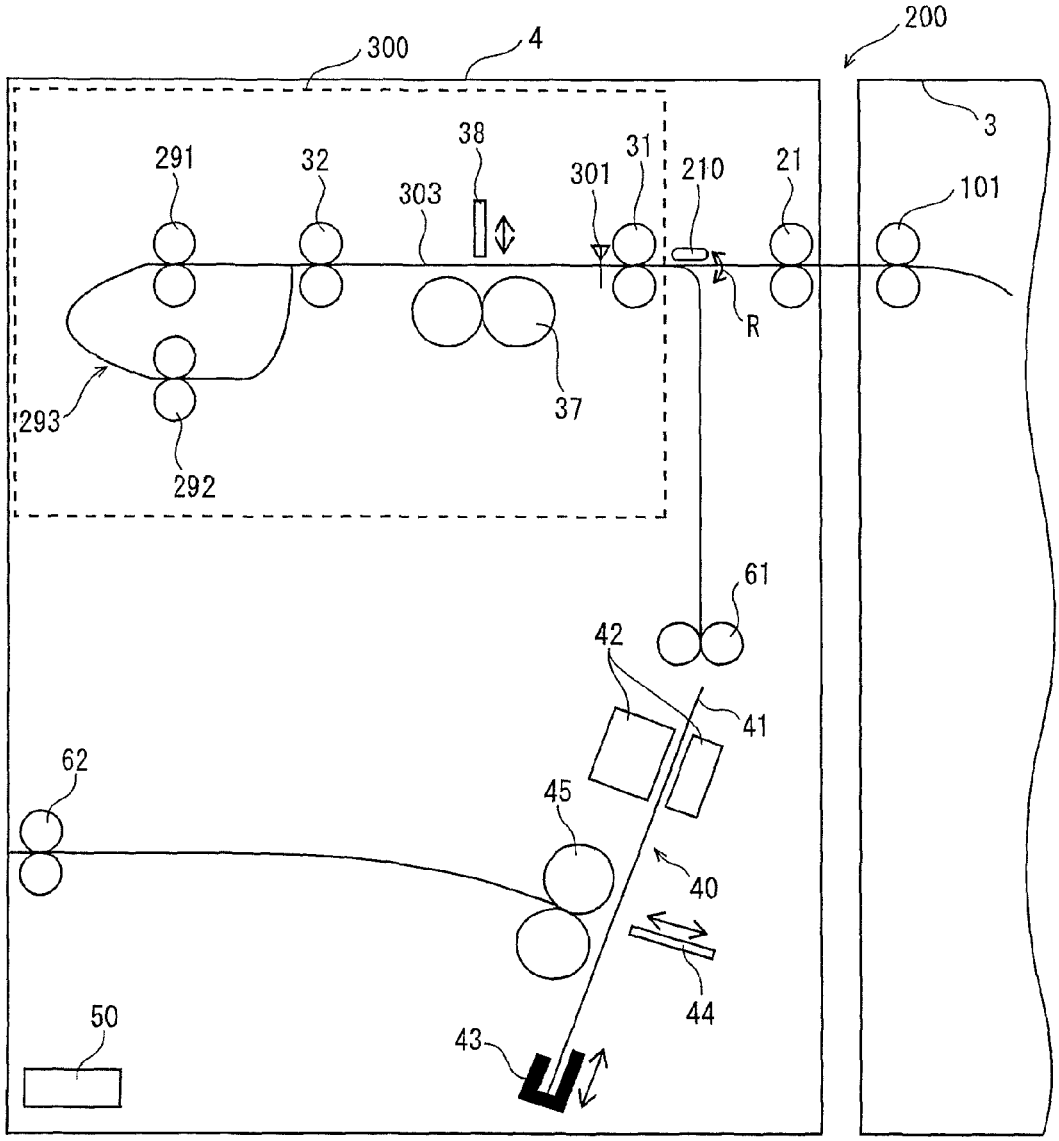
FIG. 11 shows an example of the structure of an image forming system pertaining to Embodiment 2 of the present invention.

The following mainly describes the differences. FIG. 11 shows an example of the structure of an image forming system 200 pertaining to Embodiment 2 of the present invention. The image forming system 200 is constituted from an image forming device 3 and a post-processing device 4 as shown in FIG. 11. In FIG. 11, the same constituents with those of the image forming system 100 pertaining to Embodiment 1 have the same reference numerals and the descriptions thereof are omitted.

The image forming device 3 has the same constituents with the image forming device 1, and has an unillustrated inverting mechanism for reversing the side of each sheet S. The image forming device 3 outputs a sheet S on which a toner image has been fixed by pressure and which has been outputted from the output roller pair 101 such that the side of the sheet is reversed from that outputted from the image forming device 1 pertaining to Embodiment 1.

The post-processing device 4 is different from the post-processing device 2 pertaining to Embodiment 1 in the structures of the pre-folding processing unit and the control unit. It is also different in that the post-processing device includes a path switching unit 210 that switches the transport direction of the sheet S between directions to the pre-folding processing unit 300 and to the folding processing unit 40. The path switching unit 210 switches the transport direction by rotating in the directions shown by the double-headed arrow represented by the reference sign R of FIG. 11.

The pre-folding processing unit 300 has transport roller pairs 291 and 292 provided therein. With these roller pairs, an inversion path 293 through which the sides of a sheet S are inverted is made. A guide plate (guide plate 38) is provided only at one opposing position opposite the nip portion of the pre-folding roller pair 37.

Figure 12:
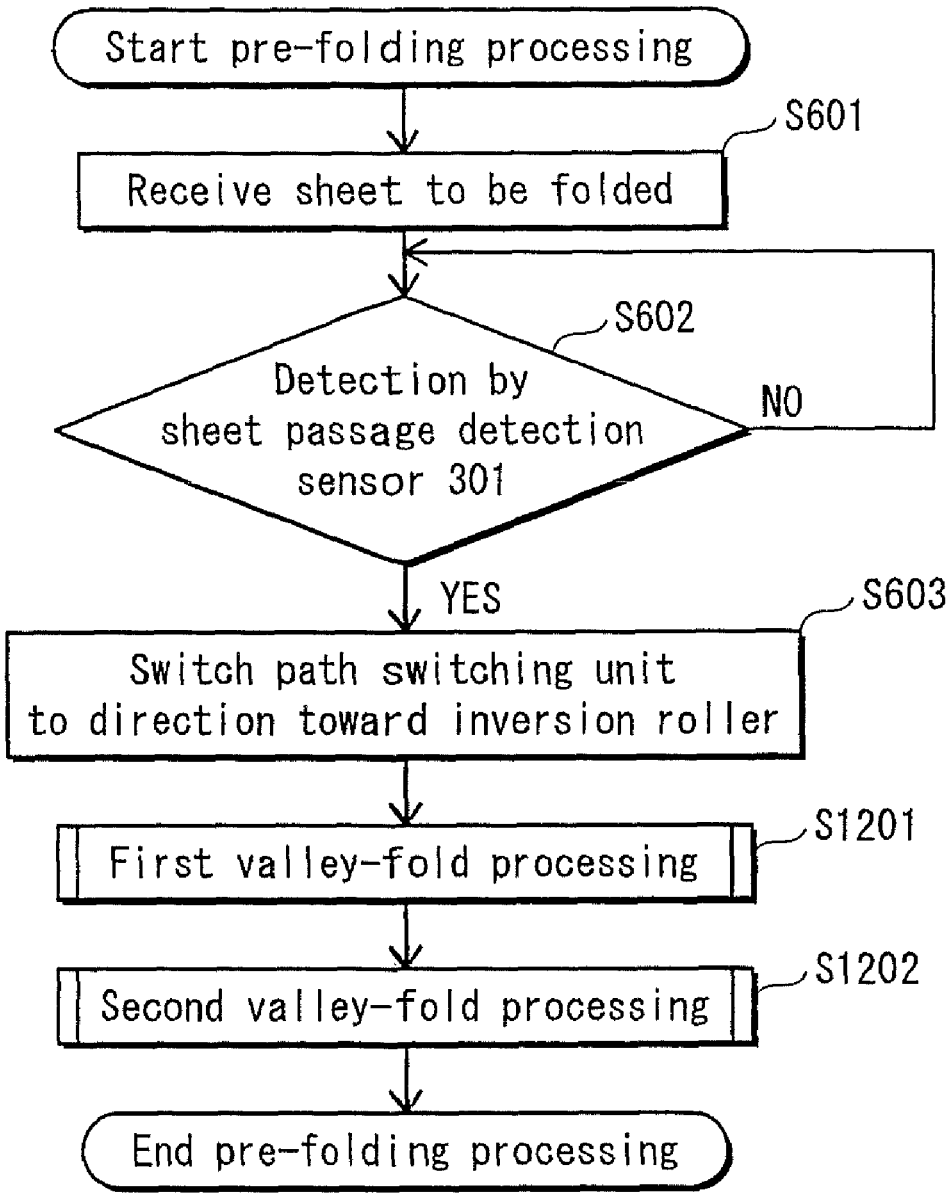
FIG. 12 is a flow chart showing the operation of the pre-folding processing performed by the control unit of the post-processing device.

FIG. 12 is a flow chart showing the operation of the pre-folding processing performed by the control unit 500 of the post-processing device 4. The same processes in the pre-folding processing as that shown in FIG. 6 pertaining to Embodiment 1 have the same step numbers, and the descriptions thereof are omitted. The control unit 500 performs the first- and second-valley-fold processing after executing processes of Steps S601-S603 (Step S1201 and S1202).

Figure 13:
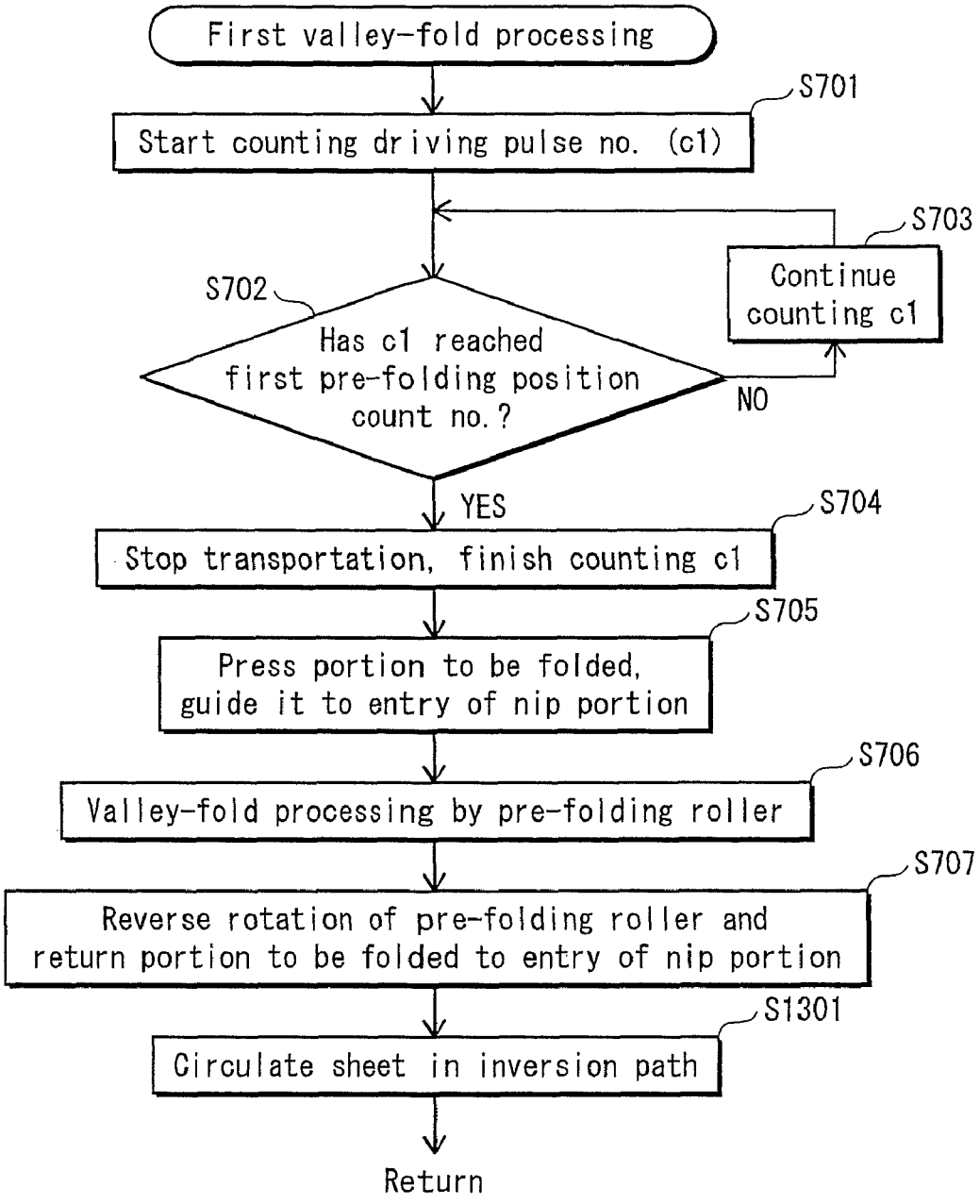
FIG. 13 is a flow chart showing the operation of first-valley-fold processing.

FIG. 13 is a flow chart showing the operation of the first-valley-fold processing. The same processes in the valley-fold processing on a portion to be folded as those shown in FIG. 7 pertaining to Embodiment 1 have the same step numbers, and the descriptions thereof are omitted. This applies to FIG. 14, which will be described later. In the first-valley-fold processing, after executing the processes of Steps S701-S707 with regard to the valley-fold processing on the portion to be folded shown in FIG. 7, the control unit 500 drives the transport roller pairs 32, 291 and 292 so as to guide the sheet S pre-folded in a V shape to go through the inversion path 293 (Step S1301).

Figure 14:
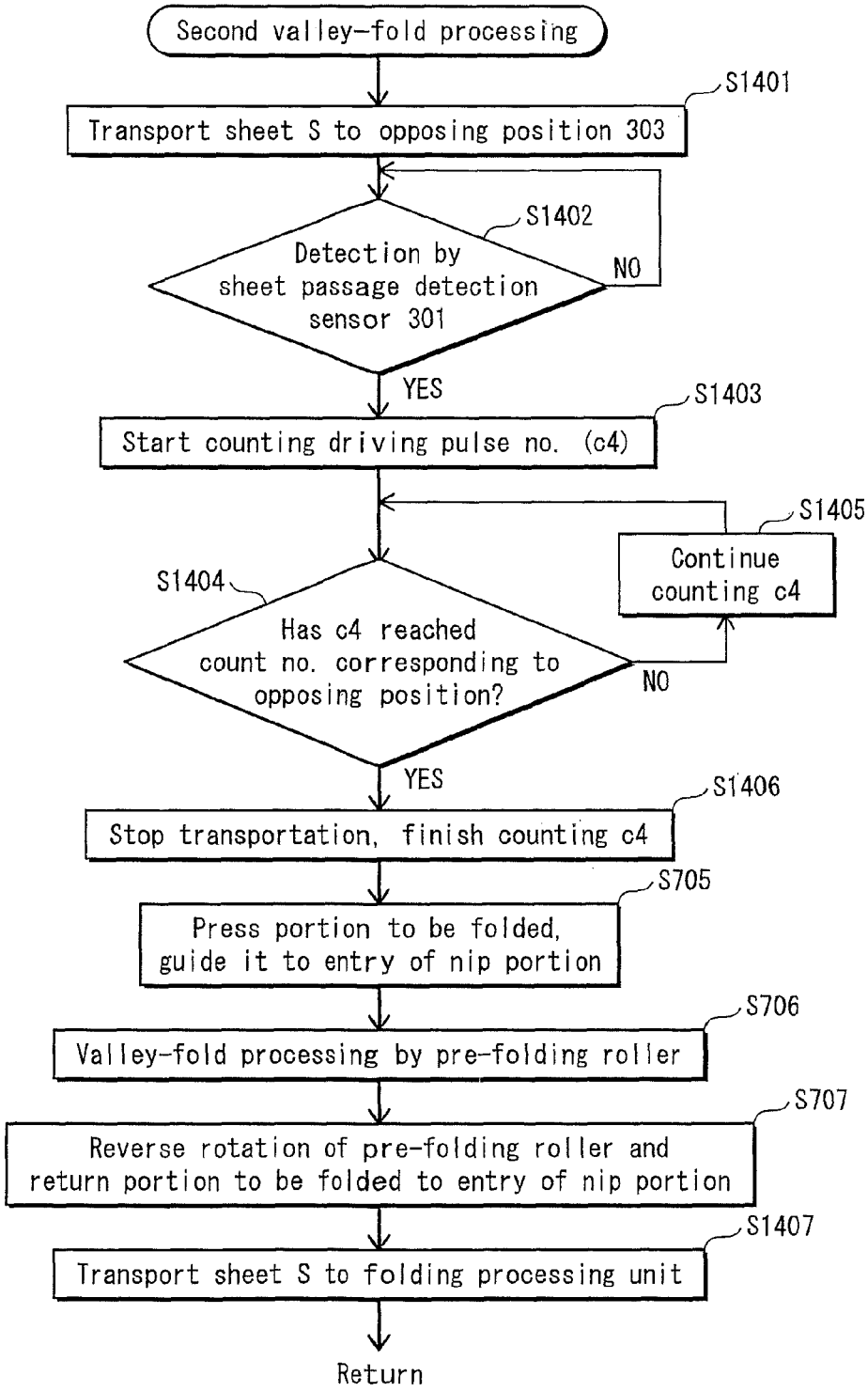
FIG. 14 is a flow chart showing the operation of second-valley-fold processing.

FIG. 14 is a flow chart showing the operation of the second-valley-fold processing. The control unit 50 drives the transport roller pair 32, and causes the sheet S having gone around the inversion path 293 to be transported in the direction toward the opposing position 303 (Step S1401). The control unit 500 monitors the sheet passage detection sensor 301. When the sheet passage detection sensor 301 detects the forward end, in the transport direction, of the sheet S (Step S1402: YES), the pulse count unit 505 starts counting the driving pulse number (c4) that is to be outputted to the driving motor of the transport roller pair 32 (Step S1403), and continues counting the driving pulse till c4 reaches the driving pulse number which is required for the portion to be folded of the sheet S to be transported to the opposing position 303 (Step S1404: NO, Step S1405).

When c3 reaches the driving pulse number (Step S1404: YES), on the assumption that the portion to be folded of the sheet S reaches the opposing position 303, the transportation of the sheet S is stopped, and the pulse count unit 505 stops counting c4 (StepS1406). Subsequently, after executing the processes in Steps S705-S707, the control unit 50 drives the transport roller pair 31 to transport the sheet S in the direction toward the folding processing unit 30 (Step S1407).

Thus, pre-folds obtained by pre-folding the sheet in a V shape and an inverted V shape can be formed in the portion to be folded.

As described above, the pre-folding processing as shown in FIG. 6 of Embodiment 1 and the pre-folding processing as shown in FIG. 12 of Embodiment 2 cause the both surfaces of a recording sheet outputted from the image forming device to be strongly pre-folding before the post-processing by a post-processing unit. This can reduce a swelling amount at the potion to be folded when the post-processing is executed thereon.

Furthermore, since a pre-fold is made in a direction substantially perpendicular to the transport direction of a recording sheet, the transport direction of the recording sheet does not need to be changed. Therefore, a space for the mechanism for switching the transport direction is not required, which can downsize the structure of the device.

[Modification]

As above, the present invention is described based on Embodiments 1 and 2. Needless to say, the present invention is not limited to the above embodiments, and the following modifications are applicable.

(1) According to Embodiments 1 and 2, pre-folding processing is performed on all the target sheets S of the folding processing. However, according to the number of sheets S in each set or the thickness of each sheet S in the set on which folding processing is to be performed in one time, necessity of the pre-folding processing may be judged. When it is judged that pre-folding processing is necessary, the pre-folding processing is performed. When it is judged that pre-folding processing is unnecessary, folding processing may be performed without execution of the pre-folding processing.

Figure 15:
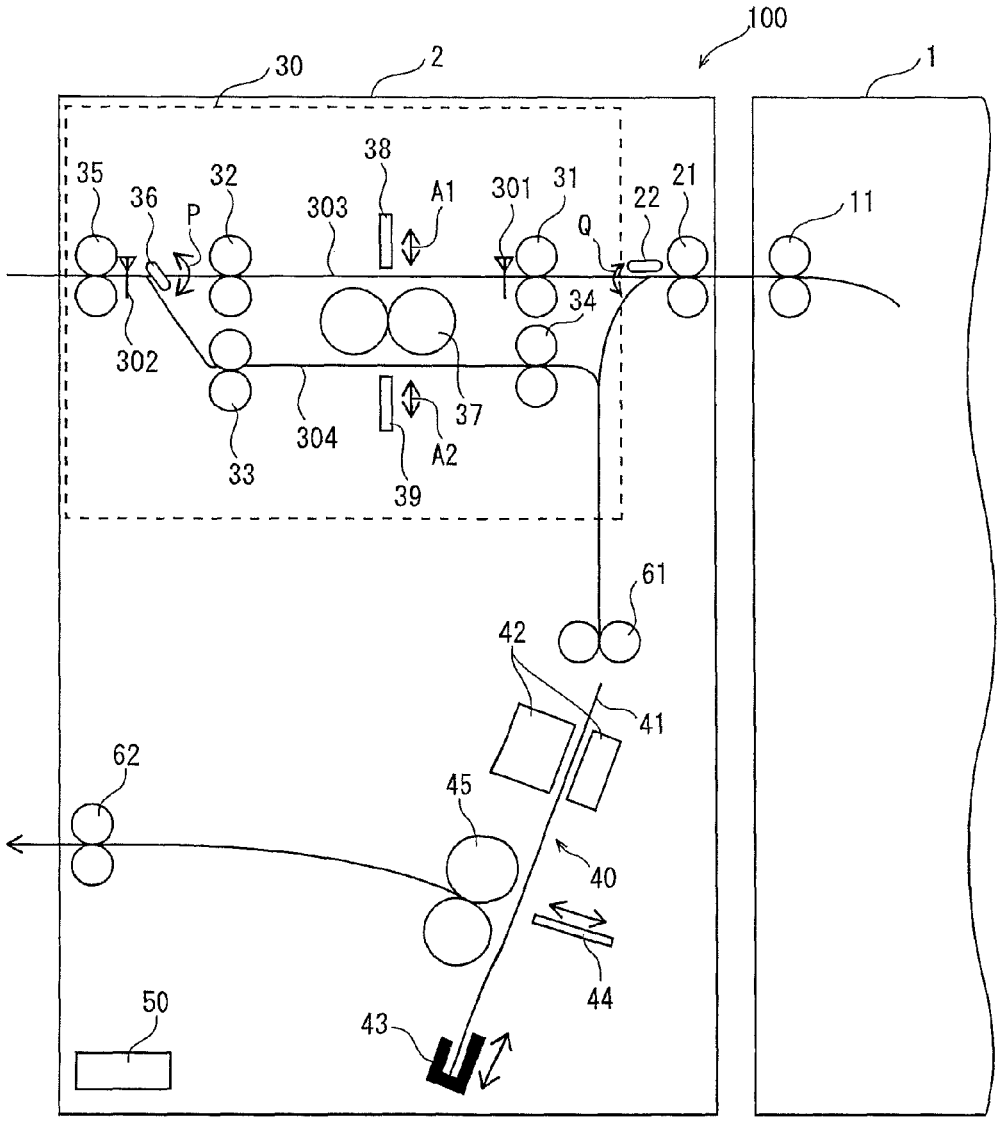
FIG. 15 shows a modification of the structure of the image forming system.
Figure 16:
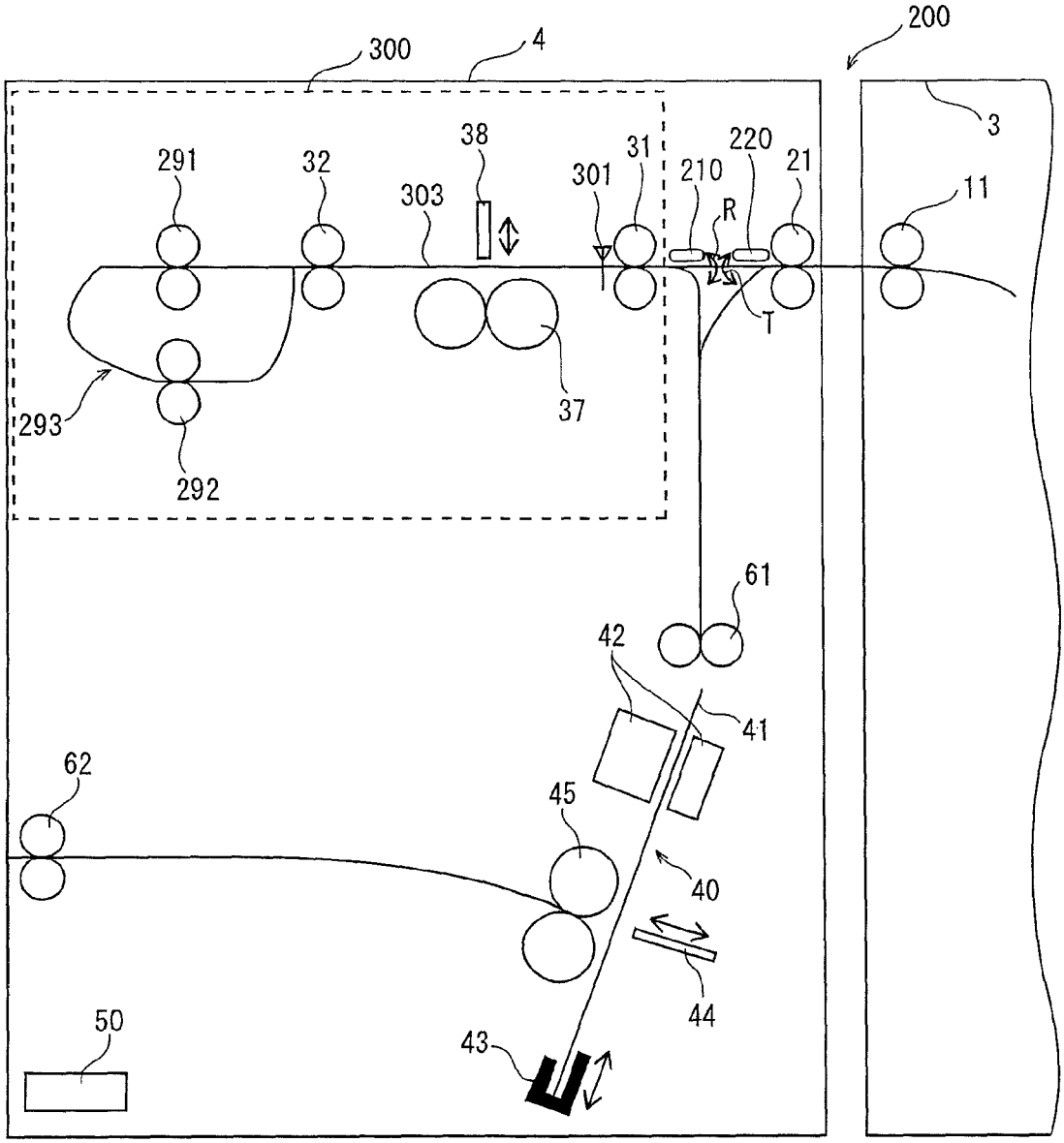
FIG. 16 shows another modification of the structure of the image forming system.

More specifically, the structure of each of the post-processing devices 2 and 4 pertaining to Embodiments 1 and 2 may be modified as follows. As shown in FIGS. 15 and 16, the post-processing devices 2 and 4 pertaining to Embodiments 1 and 2 each have a transport path for guiding a sheet S having been outputted from the output roller pair 101 to the folding processing unit 40 via the pre-folding processing unit 30 or 300, and a transport path for guiding the sheet S directly to the folding processing unit 40 without causing the sheet S to go through the pre-folding processing unit 30 or 300. The path switching unit (path switching unit represented by the reference signs 22 in FIGS. 15 and 220 in FIG. 16) switches between the transport paths by rotating in the directions shown by the double-headed arrow (double-headed arrow represented by the reference sign Q in FIG. 15 and the reference sign T in FIG. 16).

Figure 17:
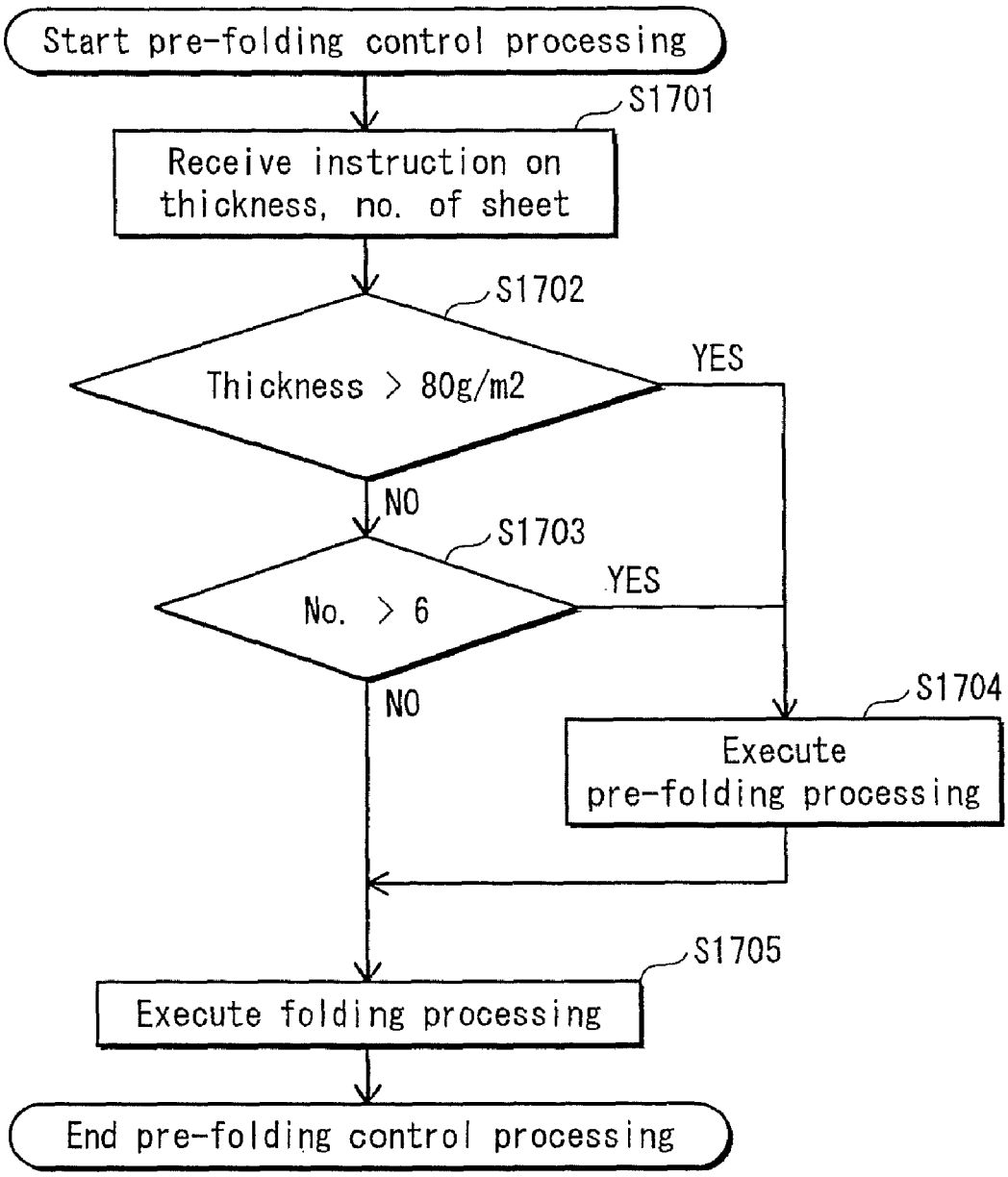
FIG. 17 is a flow chart showing the operation of the pre-folding control processing.

The control of the switching between the transport paths is performed by the control unit 50 or 500 in accordance with the flow chart of the operation shown in FIG. 17. Hereinafter, since the pre-folding control processing is similar in FIGS. 15 and 17, a description of the operation of the pre-folding control processing performed by the control unit 50 is given with reference to FIG. 17, and a description of the operation by the control unit 500 is omitted.

The control unit 50 receives an instruction of the thickness of each sheet S on which folding processing is to be performed (here, the instruction is given in grammage ($g/m^2$)) and the number of sheets S folded in one folding processing is inputted from an operation panel of the image forming device 1 via the serial communication unit 71 (Step S1701).

The control unit 50 judges whether the instructed thickness and the sheet number each exceeds a threshold value (here, the threshold of the thickness is assumed to be 80 $g/m^2$, and the threshold of the sheet number is assumed to be six) (Step S1702, Step S1703).

When each of the instructed thickness and sheet number does not exceed the threshold value (Step S1702: NO, Step S1703: NO), the control unit 50 causes the path switching unit 22 to switch to the transport path that directly guides a sheet S to the folding processing unit 40, thereby causing the folding processing unit 40 to perform the folding processing on the sheet S without execution of the pre-folding processing (Step S1705).

When the instructed thickness or sheet number exceeds the threshold value (Step S1702: YES or Step S1703: YES), the control unit 50 causes the path switching unit 22 to switch to the transport path to the folding processing unit 40 via the pre-folding processing unit 30. Thus, after causing the pre-folding processing unit 30 to execute pre-folding processing (Step S1704), the control unit 50 causes the folding processing unit 40 to execute the folding processing on each sheet S (Step S1705).

Thus, in a case where it can be expected that a swelling amount of the folded portion of the sheets S is small even if the folding processing is directly performed on the sheets S, such as a case where each sheet S is thin, or where the sheet number of the target sheets S of one folding processing is small, the folding processing can be immediately executed without execution of the pre-folding processing.

(2) In Embodiments 1 and 2, pre-folding processing is performed on the both sides of a sheet at the portion to be folded. However, pre-folding processing may be performed only on either one of the sides. With this feature, only one guide plate is required in a case of Embodiment 1, and the inversion path is not required in a case of Embodiment 2. This allows the post-processing device to be further downsized.

(3) In Embodiments 1 and 2, the pre-folding processing is performed with both ends of the sheet S being pinched between two pairs of the transport roller pairs. However, the pre-folding processing may be performed with only one end of the sheet S pinched between the transport roller pair.

(4) In Embodiment 2, the image forming device outputs a sheet S such that the side of the sheet is inverted with respect to the side of the sheet outputted from the image forming device 1 pertaining to Embodiment 1. However, the sheet S may be outputted from the image forming device with the sides of the sheet S outputted in the same condition as Embodiment 1, and the disposition of the pre-folding roller pair 37 may be exchanged with that of the guide plate 38 in the post-processing device.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A post-processing device comprising:

a pair of rollers, each arranged such that an axis direction thereof is perpendicular to a transport direction for transporting recording sheets outputted from an image forming device, operable to form a fold in the axis direction at a predetermined portion of both surfaces of each recording sheet by pinching the predetermined portion with a nip portion defined between the pair of rollers;

a first feeding member, extending in the axis direction and arranged opposite the pair of rollers, operable to move between a feeding position and a standby position, the feeding position being at a position in a vicinity of the nip portion and allowing the predetermined portion of each recording sheet to be pinched with the nip portion, the standby position being distant from the feeding position in a direction away from the nip portion;

a transport unit operable to cause the recording sheets to be sequentially transported such that the predetermined portion of the both surfaces of each recording sheet is opposite the nip portion;

a post-processing unit operable to perform post-processing on a set of the recording sheets on each of which the fold has been formed at the predetermined portion;

a second feeding member, arranged downstream from the first feeding member in the transport direction and arranged opposite the first feeding member via the pair of rollers, operable to move between another feeding position and another standby position, the another feeding position being at a position in a vicinity of the nip portion and allowing the predetermined portion of each recording sheet to be pinched with the nip portion, the another standby position being distant from the another feeding position in a direction away from the nip portion, wherein the transport unit further causes the recording sheets on each of which the fold has been formed to be sequentially transported such that the predetermined portion of the both surfaces of each recording sheet intervenes between the pair of rollers and the first feeding member and between the pair of rollers and the second feeding member.

2. The post-processing device of claim 1, wherein the transport unit has a sensor that detects an end of the recording sheet within a transport section, the transport section beginning with an opposing position at which the predetermined portion of each recording sheet intervenes between the first feeding member and the nip portion and ending with another opposing position at which the predetermined portion intervenes between the second feeding member and the nip portion.

3. The post-processing device of claim 2, wherein the transport unit controls transportation of each recording sheet according to a count number corresponding to a distance for which the recording sheet has been transported after the sensor detects the end of the recording sheet such that the predetermined portion on which the fold has been formed by the first feeding member and the nip portion reaches the other opposing position.

4. The post-processing device of claim 1, wherein the first feeding member comprises a first plate, and the second feeding member comprises a second plate.

5. A post-processing device comprising:

a pair of rollers, each arranged such that an axis direction thereof is perpendicular to a transport direction for transporting recording sheets outputted from an image forming device, operable to form a fold in the axis direction at a predetermined portion of both surfaces of each recording sheet by pinching the predetermined portion with a nip portion defined between the pair of rollers;

a first feeding member, extending in the axis direction and arranged opposite the pair of rollers, operable to move between a feeding position and a standby position, the feeding position being at a position in a vicinity of the nip portion and allowing the predetermined portion of each recording sheet to be pinched with the nip portion, the standby position being distant from the feeding position in a direction away from the nip portion;

a transport unit operable to cause the recording sheets to be sequentially transported such that the predetermined portion of the both surfaces of each recording sheet is opposite the nip portion; and a post-processing unit operable to perform post-processing on a set of the recording sheets on each of which the fold has been formed at the predetermined portion;

wherein the transport unit has an inversion path through which each recording sheet on which the fold has been formed is inverted, and the transport unit further causes the recording sheets on each of which the fold has been formed to sequentially go through the inversion path so as to invert each recording sheet, causes the inverted recording sheet to be transported such that the predetermined portion of the recording sheet intervenes between the first feeding member and the pair of rollers.

6. The post-processing device of claim 5, wherein the first feeding member comprises a first plate.

7. A post-processing device a pair of rollers, each arranged such that an axis direction thereof is perpendicular to a transport direction for transporting recording sheets outputted from an image forming device, operable to form a fold in the axis direction at a predetermined portion of both surfaces of each recording sheet by pinching the predetermined portion with a nip portion defined between the pair of rollers;

a first feeding member, extending in the axis direction and arranged opposite the pair of rollers, operable to move between a feeding position and a standby position, the feeding position being at a position in a vicinity of the nip portion and allowing the predetermined portion of each recording sheet to be pinched with the nip portion, the standby position being distant from the feeding position in a direction away from the nip portion;

a transport unit operable to cause the recording sheets to be sequentially transported such that the predetermined portion of the both surfaces of each recording sheet is opposite the nip portion; and a post-processing unit operable to perform post-processing on a set of the recording sheets on each of which the fold has been formed at the predetermined portion wherein the post-processing unit folds the set of recording sheets on which the fold has been formed at the predetermined portion, when a sheet number of the set of recording sheets or a thickness of each recording sheet is equal to a threshold value or higher, the transport unit causes each recording sheet to be transported such that the predetermined portion of the recording sheet intervenes between the first feeding member and the pair of rollers, and causes the predetermined portion to be fed to the nip portion by moving the first feeding member from the standby position to the feeding position, and when the sheet number of the set of recording sheets or a thickness of each recording sheet is lower than the threshold value, the transport unit inhibits the transportation of the recording sheet such that the predetermined portion of the recording sheet fails to reach the opposing position.

8. The post-processing device of claim 7, wherein the first feeding member comprises a first plate.

* * * * *